United States Patent [19]

Eckert, Jr. et al.

[11] 4,108,545

[45] Aug. 22, 1978

[54] DEVELOPER SUPPLY CONTROL SYSTEM IN A COPIER

[75] Inventors: Alton B. Eckert, Jr., Norwalk; Julius Gluck, Noroton Heights, both of Conn.

[73] Assignee: Pitney-Bowes, Inc., Stamford, Conn.

[21] Appl. No.: 752,346

[22] Filed: Dec. 20, 1976

[51] Int. Cl.[2] ..... G03G 15/00; B05B 5/02

[52] U.S. Cl. ..... 355/14; 118/646; 222/DIG. 1

[58] Field of Search ..... 355/3 R, 3 DD, 14; 118/646; 222/DIG. 1

[56] References Cited

U.S. PATENT DOCUMENTS

| | | | |
|---|---|---|---|
| 3,830,401 | 8/1974 | Benwood et al. | 118/646 X |
| 3,876,106 | 4/1975 | Powell et al. | 222/DIG. 1 |
| 3,932,034 | 1/1976 | Takahashi | 355/3 DD |
| 3,951,309 | 4/1976 | Kadowaki | 222/DIG. 1 X |
| 4,032,227 | 6/1977 | Hubbard et al. | 355/14 |

*Primary Examiner*—Fred L. Braun
*Attorney, Agent, or Firm*—Donald P. Walker; William D. Soltow, Jr.; Albert W. Scribner

[57] ABSTRACT

A copier of the type which includes a photoreceptor on which an electrostatic latent image may be formed, a movable applicator which carries developer from a working supply of image developer and applies it to the image, and developer dispensing instrumentalities for replenishing the working supply of developer, is provided with a system for controlling the developer dispensing instrumentalities and thus replenishment of the working supply of developer. The control system responds to the optical density of developer on the applicator to generate a signal indicating whether or not the working supply of developer is in need of replenishment, and this signal is utilized for energizing the dispensing instrumentalities. The control system also includes circuitry for preventing energization of the dispensing instrumentalities for a predetermined time interval after commencement of movement of the applicator, to be sure that the applicator has picked up a sample of the developer from the working supply. Preferably, the control system further includes circuitry for replenishing the working supply of developer for at least a predetermined minimum time interval after replenishment is commenced.

5 Claims, 1 Drawing Figure

DEVELOPER SUPPLY CONTROL SYSTEM IN A COPIER

BACKGROUND OF THE INVENTION

Commercially available electrostatic copying machines or copiers, such as the copier shown in United States Published Patent Application No. B481,048, published Mar. 16, 1976 to J. A. Toto et al, now U.S. Pat. No. 3,988,542 generally include processing instrumentalities for forming and developing an electrostatic latent image on a moving photoreceptor and thereafter transferring the developed image from the photoreceptor to a copy sheet made of a suitable material such as paper.

For image developing purposes, many of such copiers are provided with magnetic brush developing apparatus of the type shown in U.S. Pat. No. 3,924,567, issued Dec. 9, 1975 to G. A. J. Koeleman et al, which generally includes a rotatable applicator for carrying developer to the latent image from a working supply of the same carried beneath the applicator in a suitable sump. The developer comprises a suitable toner material in powder form, and a suitable ferromagnetic material in granular or bead form to which the toner material is tribo-electrically attracted. In the course of each operating cycle of the copier, the rotating applicator lifts a portion of the working supply of developer from the sump and into contact with the latent image on the moving photoreceptor, as a result of which sufficient toner is transferred from the carrier to the latent image for developing the same.

To prevent the working supply of developer from becoming gradually useless due to dissipation of its toner and/or carrier content, the working supply is rejuvenated from time-to-time by adding a replenishing supply of developer. To that end, the copier is provided with developer dispensing means for replenishing the working supply of developer. As shown in U.S. Pat. No. 3,853,246 issued Dec. 10, 1974 to R. C. DuBois, a typical arrangement of such dispensing means comprises a bottle of developer adapted to be rotated from a source of supply of motive power. The rotating bottle dispenses developer into the sump of the magnetic brush apparatus for replenishment of the working supply.

To control the dispensing means there has been provided, as discussed in the aforesaid U.S. Pat. No. 3,924,567, a device which is responsive to the reflectivity of developer on the applicator, and associated circuitry for energizing the dispensing means when the reflectivity exceeds a predetermined level. In the prior art, a conventional comparator to which the reflectivity responsive device is connected has been utilized to directly operate a relay having a contact connected to gate a triac when controls the motor driving circuit of the dispensing means; thereby controlling rotation of the bottle of replenishing developer.

One of the problems which arises in the prior art is that since the applicator is depleted of developer until it commences rotation, and the reflectivity responsive device is operative for signaling the dispensing means before the applicator carries a sample of the developer past the reflectivity responsive device, the device signals the dispensing means to add developer to the magnetic brush sump whether or not the sump has a sufficient quantity of developer therein. Another problem of the prior art relates to the sensitivity of the circuitry associated with the reflectivity responsive device. As often as not the relay which is controlled by the low developer density signal from the comparator associated with the reflectivity responsive device, is energized and deenergized at such a rapid rate that the relay contact in the triac controlled motor drive circuit chatters, resulting in the motor noisily jogging the developer resupply bottle of the dispensing means. Accordingly:

An object of the present invention is to provide an improved developer supply control system for a copier;

Another object is to provide means for controlling the developer dispensing means in a copier of the type which includes magnetic brush developing means; and Yet another object is to provide a copier including means for solving the above described problems in the prior art.

SUMMARY OF THE INVENTION

In a copier including a photoreceptor, means for forming an electrostatic latent image on the photoreceptor, a rotatable applicator for contacting the latent image with developer from the working supply, and means for dispensing a replenishing supply of developer; there is provided means for generating a signal indicating when the working supply of developer is in need of replenishment, means operable in response to said indicating signal for energizing the dispensing means, and means for preventing operation of the dispensing means for a predetermined time interval after the applicator commences rotation. Preferably, there is also included means for maintaining operation of the dispensing means for at least a second predetermined time interval after such operation is commenced.

DESCRIPTION OF THE DRAWING

As shown in the drawing, wherein like reference numerals designate like or corresponding parts.

DESCRIPTION OF THE PREFERRED EMBODIMENTS

Figure 1:
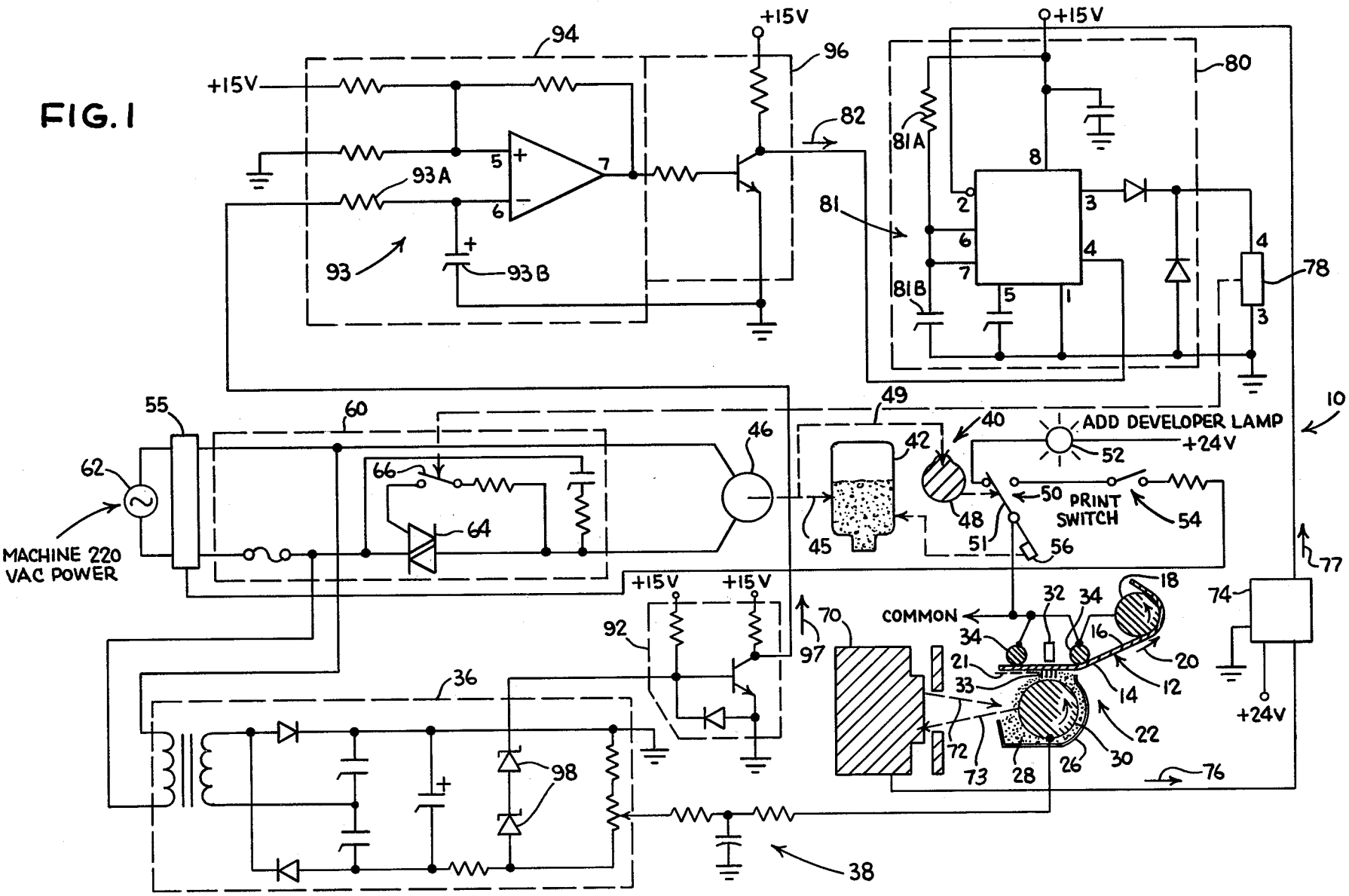
FIG. 1 is a schematic diagram of a copier including magnetic brush developing apparatus having a working supply of developer, and a control system for replenishing the working supply of developer.

An electrostatic copier 10 of the type which may be improved in accordance with the present invention, generally includes a photoreceptor 12 having a photoconductive outer surface 14 and a non-photoconductive inner surface 16. The photoreceptor 12 is looped about a plurality of guide rollers 18, one of which is shown in FIG. 1, for movement by suitable means (not shown) in an endless path of travel 20 through a plurality of processing stations including an image forming station (not shown) wherein an electrostatic image 21 is formed on the moving photoreceptor 12, and an image developing station 22.

At the developing station 22 there is provided in accordance with prior art practice a magnetic brush assembly including a sump 26 for holding a working supply of developer 28. The developer 28 includes a suitable toner component, such as a particulate of powdered pigmented resin, and a suitable ferromagnetic carrier component, such as an aggregate of iron filings to which the toner is triboelectrically attached. To upwardly carry the working supply of developer 28 from the sump 26 to the moving photoreceptor 12, the magnetic brush assembly also includes a rotatable applicator 30, made of a suitable magnetizeable material, which is immersed for rotation in the working supply of developer 28. To contact the image 21 with upwardly carried developer 28, the magnetic brush assembly further includes a magnet 32, which is magnetically coupled to the applicator 30 to form a magnetic field 33 in the space between the photoreceptor 12 and applicator 30. To hold the inner surface 16 of the photoreceptor 12 at a suitable common potential for image developing purposes one or more stationary bias rods 34 are provided. The rods 34 are suitably electrically connected to a common potential; and the photoreceptor 12 is suitably looped about the bias rods 34 for guiding the photoreceptor 12 through the developing station 22. Further, to prevent low level static charges on the photoreceptor 12 from attracting stray toner particles thereto, the copier 10 includes a conventional source of supply of power 36 having a biasing network 38 electrically connected to the applicator 30 by means well-known in the art.

In operation, the magnetic field 33 entrains ferromagnetic carrier and thus the toner of the developer 28 to form a brush-like conglomeration of developer 28 in the aforesaid space between the applicator 30 and photoreceptor 12. As a result, toner is transferred from the magnetically entrained developer 28 to the image 21 for rendering the same visible.

As the working supply of developer 28 is dissipated due to use of the toner for image developing purposes, and wear and carry-out of the carrier component, the sump 26 is replenished with developer 28. For replenishing purposes, the copier 10 includes developer dispensing means 40, which generally comprises a suitable refillable or disposable container 42, such as a bottle, means for discharging the contents of the container 42 and means for signalling that the container 42 must be refilled or replaced.

In accordance with the prior art, for discharging purposes the container 42 is adapted to be discharged upon rotation and connected by suitable means 45 to be rotatably driven by a motor 46. The signalling means includes a cam 48, connected by suitable means 49 to be rotated when the container 42 is rotated, and a switch 50 operable by the cam 48. The switch 50 preferably has a contact 51 which is movable from a first position, wherein it indicates, as by means of closing a suitable circuit to light a lamp 52, that the container 42 should be refilled or replaced, as the case may be; to a second position, wherein the absence of the aforesaid indication informs the operator that the copier 10 may be utilized. Alternatively, and preferably, movement of the contact 51 to the second position is utilized to close an enabling circuit to the print switch 54 of the copier 10, thereby enabling the control circuit 55 of the copier 10 to be operated by actuation of the print switch 54. When the container 42 is refilled or replaced, as the case may be, it is rotated one full revolution by the operator to ensure sufficient rotation of the cam 48 to move the switching contact 51 from the first position to the second position, thereby enabling the print switch 54.

In accordance with the prior art, to hold the switch contact 51 in the cam operated position, the switch 50 includes a magnet 56 which is movable by the cam 48 into sufficiently close relationship with the container 42 to magnetically couple the magnet 56 to the ferromagnetic carrier component of the developer 28 within the container 42. As a consequence, once the switch contact 51 has been initially cam operated, it remains so operated until the developer 28 within the container 42 is substantially completely depleted. At that juncture there is an insufficiency of developer 28 within the container for magnetic coupling purposes as a consequence of which the magnet 56 is decoupled; whereupon, the switching contact 51 moves from the second position to the first position, thereby disabling the print switch 54 and lighting the lamp 52 to signal the operator to refill or replace the container 42.

For energizing the motor 46 in accordance with the prior art, to thereby drive the container 42 and cam 48, the copier 10 includes a conventional triac controlled motor driving circuit 60. The input of the circuit 60 is suitably electrically connected to the copier's source of supply of power 62, via the copier's control circuitry 55, to receive input power from the source 62 whenever the print switch 54 is actuated to switch the copier 10 to its printing mode of operation. And, the output of the circuit 60 is suitably electrically connected across the motor 46. The motor driving circuit 60 includes a triac 64, which is suitably electrically connected for controlling power transfer from the input to the output of the circuit 60 in response to closure of a switching contact 66 connected in series with the gate lead of the triac 64.

For controlling switching the contact 66 and thus the motor driving circuit 60, in accordance with the prior art, there is provided means 70 for generating a signal indicative of the density of developer 28 on the applicator 30. The signal generating means 70 includes a suitable source of supply of light such as a lamp (not shown), which is adapted to shine light 72 on the applicator 30 and thus on the developer 28 coating thereon; and a photocell (not shown) which is responsive to reflected light 73 from the developer 28 on the applicator 30 for generating a signal 76 proportional to the optical density of developer 28 on the applicator 30. In addition, there is provided a conventional comparator circuit 74, which includes means for amplifying the signal 76, comparing the amplified signal to a suitable reference level to establish whether or not developer 28 should be added to the sump 30, and means for providing a suitable signal 77 indicative that developer 28 should be added whenever the comparison represents that the developer density is less than a predetermined minimum level.

In accordance with the prior art, the comparator signal 77 may be amplified to the extent necessary for directly energizing a relay 78, for closing contact 66, thereby gating the triac 64 to energize the motor 46 for discharging developer 28 from the container 42 to the sump 26.

With this arrangement it has been found that the relay 78 is often so rapidly energized and deenergized that the contact 66 chatters; resulting in undue wear of the relay 78, the motor 46 being jogged, and the dispensing means 40 being noisily operated. Further, the aforesaid circuitry does not compensate for comparator signals 77 which are generated when the copier 10 is energized and the applicator 30 has not rotated sufficiently to be coated with a sample of the working supply of developer 28.

In accordance with the invention there is provided developer supply control means including a latch which preferably comprises a monostable multivibrator 80, such as the multivibrator manufactured by Signetics Corporation as Part Number 555. The multivibrator 80 is suitably electrically connected so to be triggered by the signal 77 and adapted by well-known means to drive the relay 78. In addition, the multivibrator 80 is arranged so as to be non-responsive to the trigger signal 77 received at lead 2 of the multivibrator 80 unless an enabling signal 82 is present at lead 4 of the multivibrator 80. Further, the multivibrator includes a suitable R-C circuit 81, such as resistor 81A and capacitor 81B for controlling the operating characteristics of the multivibrator 80 such that when it is operated the relay 78 remains operated for a sufficient time interval to permit the container 42 to be rotated at least (1/10) of a revolution by the energized motor 46 irrespective of the time duration of the trigger signal 77; and the relay 78 remains operated during the time duration of the trigger signal 77 whenever such time duration exceeds the time interval necessary to permit the container 42 to be rotated one-tenth (1/10) of a revolution by the energized motor 46. Accordingly, the energized motor 46 rotates the container 42 at least 1/10 of a revolution or during the duration of the trigger signal 77 at lead 2 of the multivibrator 80 depending on the time interval the trigger signal 77 is impressed on lead 2 when the enabling signal 82 is impressed on lead 4 of the multivibrator 80.

To provide the enabling signal 82 in accordance with the invention, the developer supply control means utilizes an existing source of supply of D.C. power within the copier 10, such as the negative supply 36, a conventional transistor switch 92, an R-C time delay circuit 93, a comparator 94 and a second transistor switch 96.

In accordance with the invention, the negative supply 36 is modified to include one or more zener diodes 98, electrically connected in series with each other, across the output of the supply 36, and in series with the base of switch 92. When the print switch 54 is actuated and the control circuit 55 activitates the motor driving circuit 60 and supply 36. The supply 36 operates the switch 92 to provide a positive level signal 97 at the collector of the switch 92, which signal 97 indicates that the copier 10 is in its printing mode of operation. The positive signal 97 is fed to input lead 6 of the comparator 94 via the R-C time delay circuit 93, including resistor 93A and capacitor 93B. The R-C circuit 93 is connected between lead 6 of the comparator 94 and the collector of switch 92, whereas lead 5 of the comparator is held at a suitable reference level by the conventional arrangement of circuit elements associated with lead 5. The time constant of the R-C circuit 93 is chosen to provide a time delay substantially equal to the time required for the copier 10 to rotate the applicator 30 a single revolution, for example, approximately (½) a second. Thus, approximately (½) a second elapses from the time the switch 92 conducts to the time the signal level at lead 6 of the comparator 94 corresponds to the signal level at lead 5 of the comparator 94; whereupon the output signal level at lead 7 of the comparator goes negative to operate switch 96; as a result of which switch 96 operates to provide a positive level signal 82 at the collector of switch 96, which signal 82 is applied as an enabling signal to lead 4 of the multivibrator 80. Since the multivibrator 80 is unable to operate the relay 78 until such time as the enabling signal 82 is applied to lead 4 of the multivibrator 80, and the signal 77 is not so applied until approximately (½) second after the applicator 30 commences rotation; if the applicator 30 is devoid of developer 28 when the copier 10 is initially energized, and the signal generating means 70 impresses a signal 76 on the comparator 74 which results in a trigger signal 77 at lead 2 of the multivibrator 80, power will not be transferred from lead 8 to lead 3 of the multivibrator 80 unless the trigger signal 77 persists for a greater time period than the approximately ½ second after commencement of rotation of the applicator 30. Of course, since the signal generator 70 is disabled from operating the relay 78 for approximately (½) a second after commencement of rotation of the applicator 30, applicator 30 rotates for a sufficient time interval to permit the same to be coated with a sample of the working supply of developer 28 before the developer supply control system is operative to replenish the sump 26 with developer 28.

In accordance with the objects of the invention there has been described an electrostatic copier including improved means for supplying developer to magnetic brush developer assembly of the copier.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is

1. In a copier including a photoreceptor, means for forming an electrostatic latent image on the photoreceptor, a rotatable applicator for contacting the latent image with developer from a working supply thereof, and means for dispensing a replenishing supply of developer, developer supply control means comprising:

a. means for generating a signal indicative that the working supply of developer is in need of replenishment;
b. means operable in response to said indicating signal for energizing the dispensing means;
c. means for preventing energization of the dispensing means for a first predetermined time interval after the applicator commences rotation and
d. means for maintaining energization of the dispensing means for a second predetermined time interval after energization thereof.

2. The developer supply control means according to claim 1, wherein said means for preventing energizing said dispensing means includes a first R-C time delay circuit, and said means for maintaining energization of said dispensing means includes a second R-C time delay circuit.

3. The developer supply control means according to claim 1, wherein said means for preventing energization of said dispensing means includes comparator means operable to provide an enabling signal indicative that said applicator has rotated for said first predetermined time interval, said energizing means including latching means operable in response to the coincidence of said indicating signal and said enabling signal, and said means for maintaining energization including a time delay circuit operable to maintain rotation of said applicator for said second predetermined time interval.

4. The developer supply control means according to claim 1, wherein said preventing means includes:

a. means for producing a signal representative that the copier is in a printing mode of operation,
b. means responsive to said printing mode signal for generating a signal to enable operation of said means for energizing the dispensing means; and
c. means for delaying said enabling signal.

5. The developer supply control means according to claim 4, wherein said means responsive to said printing mode signal comprises a comparator operable connected to said delay means and to said means for energizing said dispensing means.

* * * * *